US009991659B2

(12) United States Patent
Ostermann et al.

(10) Patent No.: US 9,991,659 B2
(45) Date of Patent: Jun. 5, 2018

(54) HAND-OPERATED TOOL, GROUND CONTACT MOUNTING SET AND METHOD FOR MOUNTING A TERMINAL ONTO A GROUND STUD CONTACT, IN PARTICULAR FOR A CAR BODY

(71) Applicant: TE Connectivity Germany GmbH, Bensheim (DE)

(72) Inventors: Rudiger Ostermann, Rimbach (DE); Hartmut Ripper, Darmstadt (DE); Mile Trajkov, Frankfurt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days. days.

(21) Appl. No.: 15/440,045

(22) Filed: Feb. 23, 2017

(65) Prior Publication Data

US 2017/0244210 A1 Aug. 24, 2017

(30) Foreign Application Priority Data

Feb. 23, 2016 (EP) ..... 16156934

(51) Int. Cl.
*H01R 43/042* (2006.01)
*H01R 4/18* (2006.01)
*H01R 43/048* (2006.01)

(52) U.S. Cl.
CPC ..... *H01R 43/042* (2013.01); *H01R 4/18* (2013.01); *H01R 43/048* (2013.01)

(58) Field of Classification Search
CPC ..... H01R 43/042; H01R 4/18; H01R 43/048
USPC ..... 439/879
See application file for complete search history.

(56) References Cited

U.S. PATENT DOCUMENTS 4,512,219 A * 4/1985 Janssen ..... B25B 13/06 81/121.1
5,263,390 A * 11/1993 Levy ..... B25B 23/00 81/121.1
5,292,264 A * 3/1994 Blank ..... H01R 4/64 439/809

(Continued)

FOREIGN PATENT DOCUMENTS

DE 102006015632 A1 10/2007
EP 2063492 A2 5/2009
FR 2907701 A1 5/2008

OTHER PUBLICATIONS

European search report, dated Aug. 18, 2016, 7 pages.
Abstract of FR2907701, dated May 2, 2008, 2 pages.
Abstract of DE102006015632, dated Oct. 11, 2007, 2 pages.

*Primary Examiner* — Alexander Gilman
(74) *Attorney, Agent, or Firm* — Barley Snyder

(57) ABSTRACT

A tool for mounting a terminal onto a stud contact is disclosed. The tool has a receptacle, a stud detector, and an indicator. The receptacle is open in a mounting direction and receives the terminal. The stud detector detects a final installation position of the stud contact within the receptacle. The indicator is visible from an exterior of the tool and is connected to the stud detector. The indicator has a first visual appearance and a second visual appearance different from the first visual appearance, and automatically switches between the first visual appearance and the second visual appearance based on whether the stud contact is in the final installation position.

20 Claims, 6 Drawing Sheets

(56) References Cited

U.S. PATENT DOCUMENTS

| | | | | |
|---|---|---|---|---|
| 6,122,997 | A * | 9/2000 | Altura | B25B 13/48 81/119 |
| 6,990,866 | B2 * | 1/2006 | Kibblewhite | F16B 31/02 73/761 |
| 7,278,341 | B1 * | 10/2007 | Novin | B25B 13/065 411/428 |
| 7,698,949 | B2 * | 4/2010 | Akdeniz | G01L 5/243 310/322 |
| 8,162,702 | B2 * | 4/2012 | Opper | B25B 23/00 439/793 |
| 8,683,869 | B2 * | 4/2014 | Herley | G01L 5/246 73/760 |
| 8,918,993 | B2 * | 12/2014 | Braden | H01R 4/646 29/844 |
| 2003/0095847 | A1 * | 5/2003 | Cheal | F16B 5/02 411/9 |
| 2004/0050567 | A1 * | 3/2004 | Tambini | B25B 23/1405 173/93.5 |
| 2005/0161241 | A1 * | 7/2005 | Frauhammer | B25F 5/00 173/1 |
| 2006/0123917 | A1 * | 6/2006 | Kibblewhite | F16B 31/02 73/761 |
| 2006/0130590 | A1 * | 6/2006 | Kibblewhite | F16B 25/10 73/761 |
| 2008/0118325 | A1 * | 5/2008 | Opper | H01R 4/302 411/103 |
| 2009/0055028 | A1 * | 2/2009 | Kibblewhite | B25B 21/00 700/275 |
| 2009/0173161 | A1 * | 7/2009 | Kibblewhite | G01L 1/255 73/761 |
| 2013/0047408 | A1 * | 2/2013 | Kibblewhite | B25B 21/002 29/525.01 |
| 2017/0023425 | A1 * | 1/2017 | Kibblewhite | F16B 11/006 |
| 2017/0229796 | A1 * | 8/2017 | Kitagawa | H01R 4/64 |

* cited by examiner

HAND-OPERATED TOOL, GROUND CONTACT MOUNTING SET AND METHOD FOR MOUNTING A TERMINAL ONTO A GROUND STUD CONTACT, IN PARTICULAR FOR A CAR BODY

CROSS-REFERENCE TO RELATED APPLICATION

This application claims the benefit of the filing date under 35 U.S.C. § 119(a)-(d) of European Patent Application No. 16156934.8, filed on Feb. 23, 2016.

FIELD OF THE INVENTION

The present invention relates to a tool, and more particularly, to a tool for mounting a terminal on a ground stud contact.

BACKGROUND

In the car industry, savings in fuel consumption are achieved by reducing the weight of the car. Car bodies are consequently increasingly made from light-weight materials, such as aluminum or fiber-reinforced resin. These materials create new challenges for attaching electric connectors to the car body, such as a ground stud, as the ground stud may come loose more easily than with conventional car bodies. Moreover, as modern cars comprise more and more technology, filling up the available installation spaces in the car, the contact studs of the car body are often difficult to access and difficult to see for forming connections.

SUMMARY

An object of the invention, among others, is to provide a tool for easily and reliably mounting electrical connectors such as terminals onto stud contacts. The disclosed tool has a receptacle, a stud detector, and an indicator. The receptacle is open in a mounting direction and receives the terminal. The stud detector detects a final installation position of the stud contact within the receptacle. The indicator is visible from an exterior of the tool and is connected to the stud detector. The indicator has a first visual appearance and a second visual appearance different from the first visual appearance, and automatically switches between the first visual appearance and the second visual appearance based on whether the stud contact is in the final installation position.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
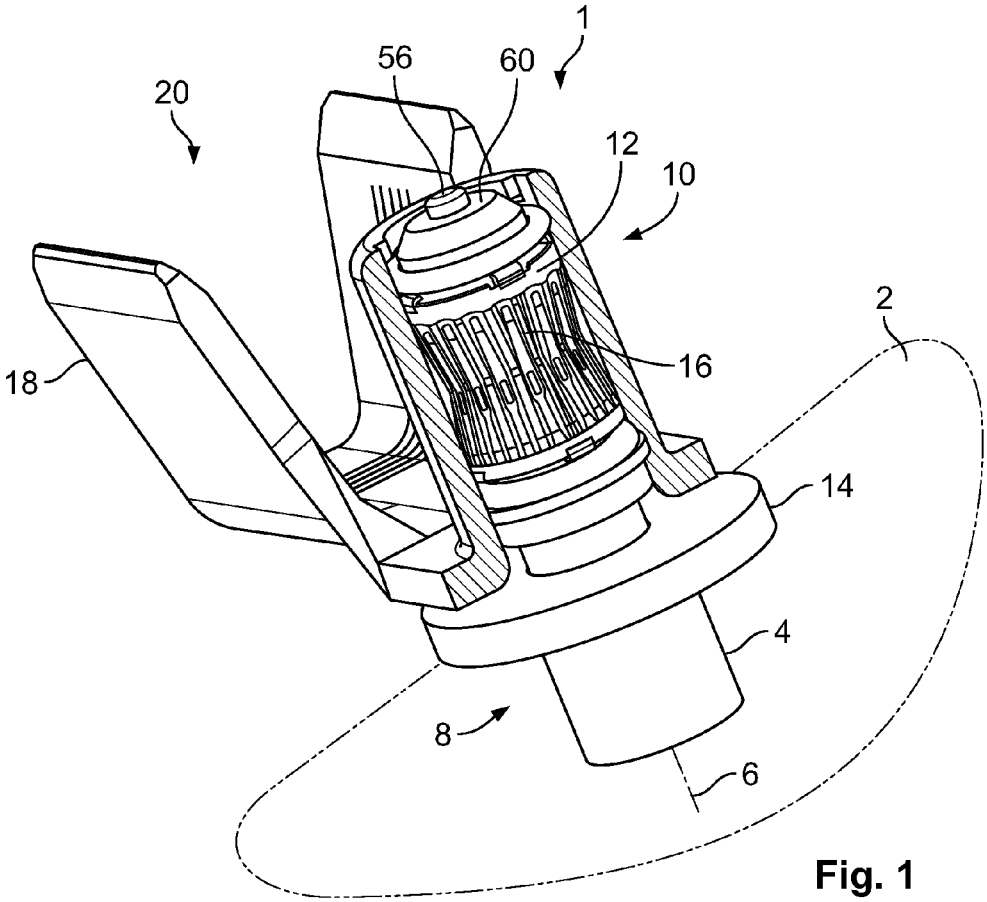
FIG. 1 is a perspective view of a stud contact and a terminal.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

An assembly 1 according to the invention for providing a ground connection in a car body 2 is shown generally in FIG. 1. The assembly 1 comprises a stud contact 4 having a longitudinal axis 6. A mounting section 8 of the stud contact 4 is inserted into the car body 2. A connecting section 10 of the stud contact 4 may be bolt-shaped and protrude, once the stud contact 4 is mounted to the car body 2, from the car body 2 to be contacted by a terminal 12. Between the mounting section 8 and the connecting section 10, the stud contact 4 has a flange 14, which rests on the car body 2 and thus acts as a stop to limit the insertion of the stud contact 4 into the car body 2.

The terminal 12 is mounted onto the stud contact 4, in particular onto the connecting section 10. The terminal 12 is sleeve-like, and the stud contact 4 is inserted into the terminal 12 and engaged with the terminal 12 by a form-fit. The terminal 12 has a spring section 16 which is elastically deflectable in a radial outward direction. The spring section 16 is part of a contact section 17, shown in FIGS. 5 and 6, into which the stud contact 4 is inserted and which establishes an electric contact between the terminal 12 and the stud contact 4. The terminal 12 also has a wire connection section 18 including a crimp section 20 for connecting a ground wire. As shown, the wire connection section 18 protrudes radially outwards from the terminal 12 and rests on the flange 14.

The stud contact 4 is first mounted onto the car body 2, then after installing further equipment on the car body 2, the terminal 12 is mounted onto the stud contact 4. At this stage, the stud contact 4 may not be easily accessible. Moreover, it may be difficult to assess whether the terminal 12 has been correctly mounted onto the stud contact 4, as the stud contact 4 may be in a location where visual assessment is difficult or impossible.

Figure 2:
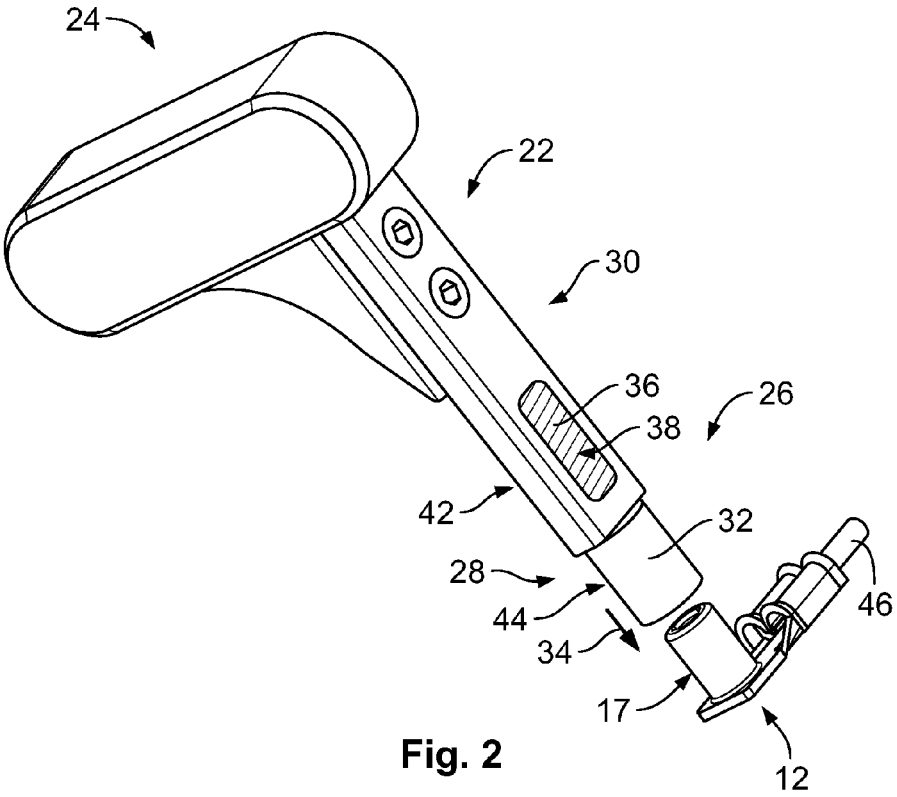
FIG. 2 is a perspective view of a tool according to the invention and the terminal.
Figure 3:
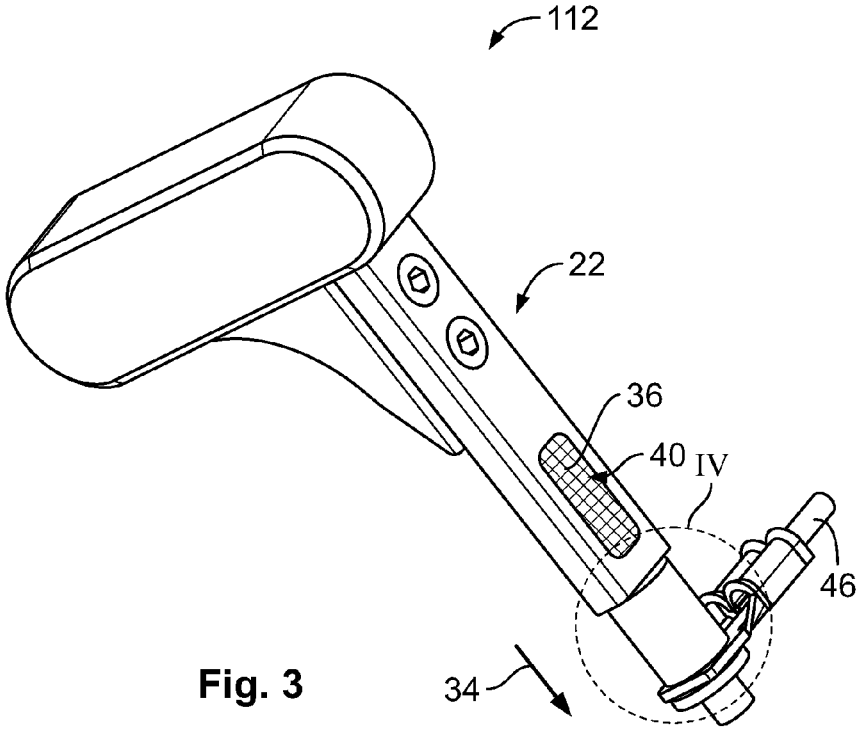
FIG. 3 is a perspective view of the tool of FIG. 2 with the terminal mounted on the stud contact.
Figure 4:
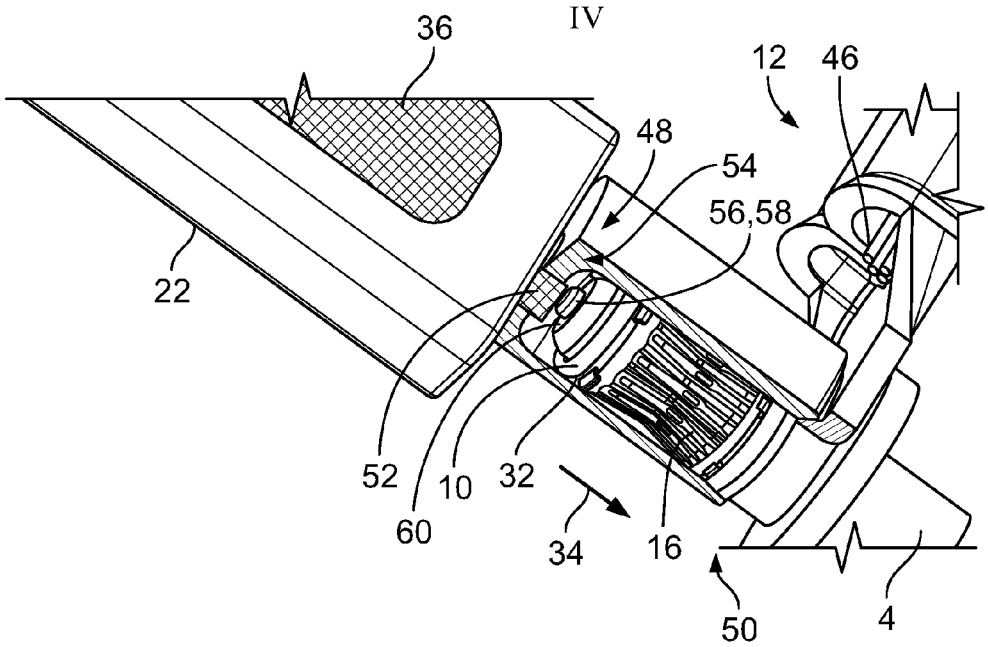
FIG. 4 is a sectional perspective view of detail IV of FIG. 3.

To facilitate the mounting of the terminal 12 onto the stud contact 4 and to assure that the terminal 12 is correctly mounted onto the stud contact 4, the tool 22 shown in FIGS. 2-4 may be used.

The tool 22 has a grip end 24 adapted to be used manually by an operator. The tool 22 also has a tool end 26 located at a distal end 28 of a longitudinal tool section 30 which extends away at an angle, for example perpendicularly, from the grip end 24. The shape and size of the tool section 30 may be adapted to specific needs. For example, a long, narrow tool section 30 may be necessary if the stud contact 4 is mounted to the car body 2 at the bottom of the engine compartment and only a long and narrow access opening is available.

The tool 22 has a receptacle 32 disposed at the tool end 26. The receptacle 32 is a hollow member, in which the terminal 12, in particular its contact section 17, is received. The receptacle 32 is open in a mounting direction 34 in which the terminal 12 is placed over the stud contact 4.

The tool 22 has an indicator 36 disposed to be visible from an exterior of the tool 22 and adapted to be switched from a first visual appearance 38, shown in FIG. 2, to a second visual appearance 40 shown in FIGS. 3 and 4. In the embodiment shown in FIGS. 2-4, the indicator 36 is a light-emitting device such as a LED, and may be a multi-color LED or an assembly of differently-colored LEDs. The indicator 36 may also be designed for tactile feedback such as vibration in addition to or instead of producing visual feedback. The first visual appearance 38 may either be that the LED 42 is switched off or that it emits light using a first set of light wavelengths, for example, to produce a red light. The first visual appearance 38 of the indicator 36 indicates that the process of mounting the terminal 12 onto the stud contact 4 has not been successfully completed. The indicator 36 is disposed close to the grip end 24.

In the second visual appearance 40, the LED 42 may be switched on or the indicator 36 may emit a different set of wavelengths to represent a different, for example a green light, signal that the installation of the terminal 12 onto the stud contact 4 has been successfully completed. Thus, the tool 22 allows for a correct mounting of the terminal 12 onto the stud contact 4, even if the stud contact 4 is not visible to the operator.

The receptacle 32 of the tool 22 is formed by an interchangeable adaptor 44 attached to the tool end 26. For inserting the terminal 12 into the receptacle 32, the receptacle 32 is moved in the mounting direction 34 over the terminal 12, as shown in FIG. 2. The tool 22 with the terminal 12 received in the receptacle 32 is then moved over the stud contact 4 as shown in FIG. 3 and in closer detail in FIG. 4.

Upon moving the terminal 12, in particular its contact section 17 over the stud contact 4, both are form-fit and engaged automatically. As shown in FIG. 4, the spring section 16 has been moved over the connecting section 10 of the stud contact 4. A wire 46 is attached to the wire connection section 18 of the terminal 12.

The tool 22, as shown in FIG. 4, also has a stud detector 48 that is operatively connected to the indicator 36. The stud detector 48 detects at least a final installation position 50 of the terminal 12 on the stud contact 4 by detecting at least one position of the stud contact 4 within the receptacle 32. The stud detector 48 switches the indicator 36 from the first visual appearance 38 to the second visual appearance 40 if the stud contact 4 is in the final installation position 50. The stud detector 48 has a sensor 52, which may be a mechanical sensor such as a switch, and/or a capacitive, optical, magnetic or electric sensor. The stud detector 48, and particularly the sensor 52, is located at a bottom 54 of the receptacle 32. The stud contact 4 has a trigger 56, which may comprise at least one protrusion 58. The protrusion may be tab-, rib-, stud- or pin-like as shown in FIG. 4. The trigger 56 interacts with the stud detector 48 in the final installation position 50 and triggers a switching of the indicator 36 from one visual appearance 38, 40 to the other visual appearance 40, 38 by moving into or out of the final installation position 50.

The trigger 56 is disposed at a top surface 60 of the stud contact 4, the top surface 60 facing counter to the mounting direction 34. As shown in FIG. 4, the trigger 56 is a protrusion 58 at the center of the top surface 60, which is aligned concentrically with the longitudinal axis 6.

In order to safely attach the terminal 12 to the tool 22 before mounting the terminal 12 onto the stud contact 4, a latching assembly 70 is provided as is described in the following with reference to FIGS. 5-7.

The latching assembly 70 is disposed on the outside 72 of the receptacle 32 and on the terminal 12. The latching assembly 70 extends across only a section of the respective circumferences of the receptacle 32 and the terminal 12. The latching assembly 70 is disposed diametrically opposite to the connection section 18.

The latching assembly 70 is operated by slipping the receptacle 32 over the contact section 17 of the terminal 12. In the latched state of the latching assembly 70, two latching members 74, 76 engage with each other in the mounting direction to form a positive lock. At least one of the latching members 74, 76 is elastically deflectable in a radial direction 78. At least one of the latching members 74, 76 is a radial protrusion. The embodiment of FIG. 5 shows a radial protrusion 80 as the latching member 74 of the receptacle 32, while latching member 76 of the terminal 12 is a latching tongue 82 protruding radially outwards. Instead of a radial protrusion 80, a radial recess may alternatively be provided.

The latching assembly 70 also has a release opening 84 opening in the mounting direction 34. The release opening 84 provides access to at least one of the latching members 74, 76; at least one of the latching members 74, 76 may overlap the release opening 84. In the shown embodiment, the release opening 84 is formed in the terminal 12 and the latching member 74, which overlaps the release opening 84, is part of the tool 22.

Figure 5:
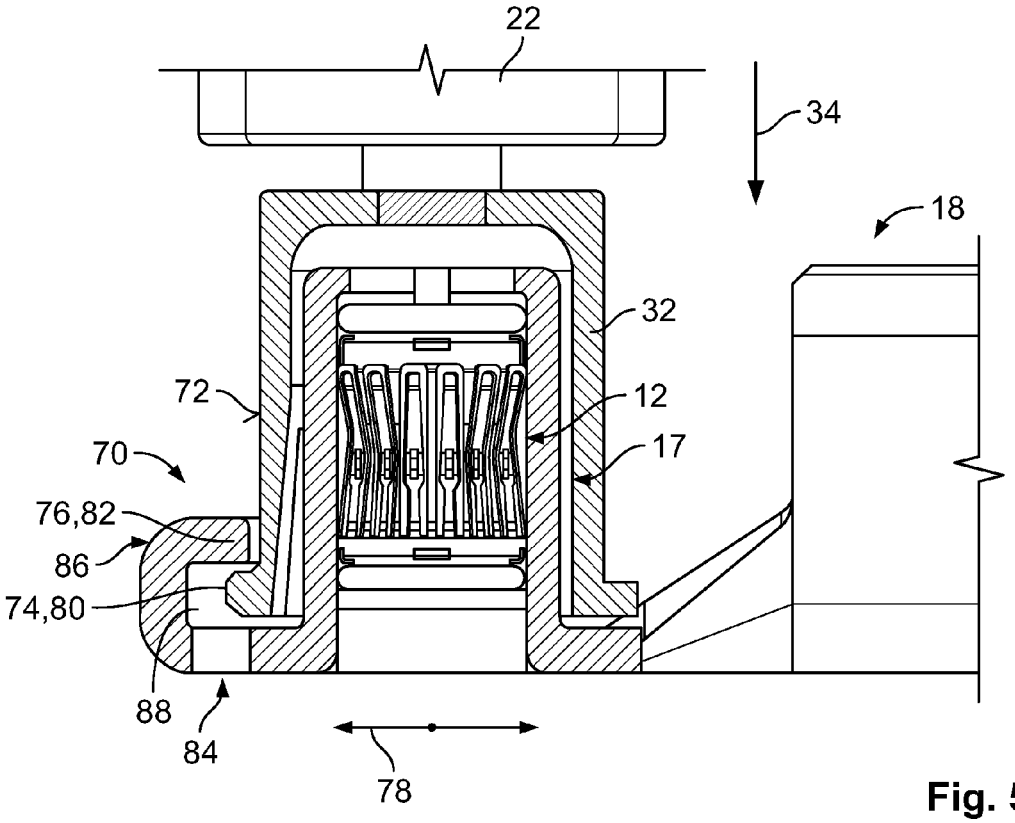
FIG. 5 is a sectional front view of the tool of FIG. 2 and the terminal.

The terminal 12, as shown in FIG. 5, has a U-shaped section 86 which forms a latch opening 88 for the latching member 74 of the receptacle 32. The release opening 84 may extend into this latch opening 88. The U-shaped section 86 may be formed by a tongue, in particular the latching tongue 82, which is bent backwards on itself to form two legs extending perpendicular to the mounting direction 34. The latch opening 88 serves as a recess receiving the latching member 74 in the latched state of the latching assembly 70.

Figure 6:
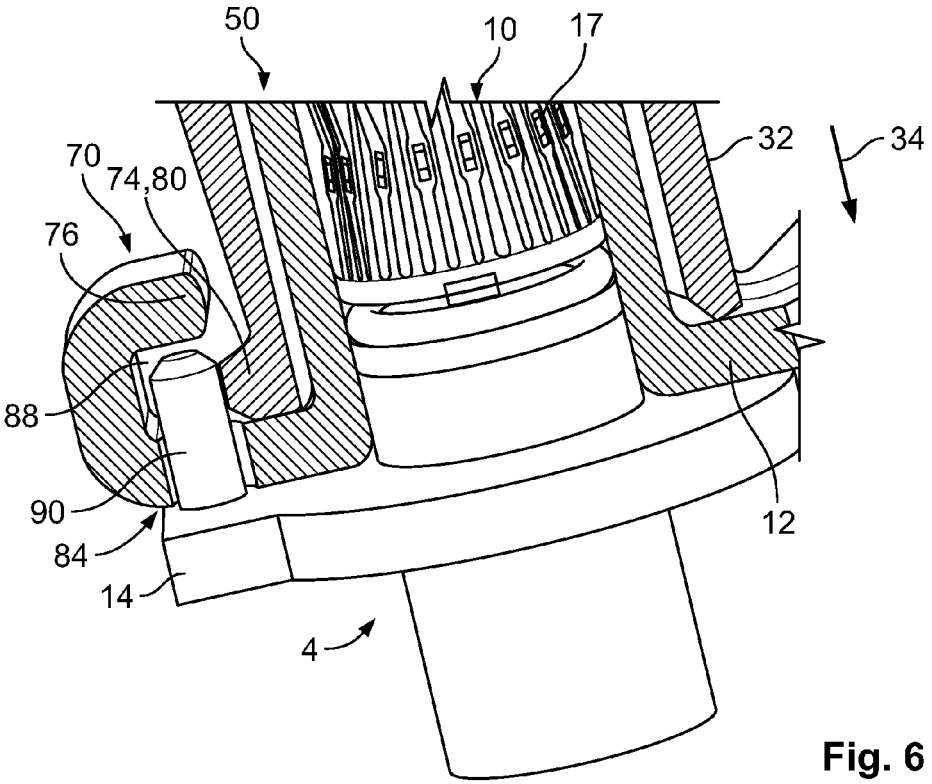
FIG. 6 is a sectional perspective view of the tool of FIG. 2 and the terminal positioned on the contact stud.

A release element 90, as shown in FIG. 6, is inserted into the release opening 84 to disengage the latching assembly 70 and thus the lock between the receptacle 32 and the terminal 12. By disengaging the latching assembly 70, the terminal 12 may be removed from the receptacle 32. The release opening 84 allows an automatic disengagement of the terminal 12 from the receptacle 32 when the stud contact 4 is in the final installation position 50.

The release element 90, as shown in FIG. 6, is disposed on the stud contact 4, for example, as a protrusion on the shoulder 14. The release element 90 extends from the stud contact 4 parallel to the connecting section 10 of the stud contact 4 and counter to the mounting direction 34.

The release element 90 is adapted to be inserted into the release opening 84 and to interact with at least one of the latching members 74, 76 to disengage the latching assembly 70. For disengagement, at least one of the latching members 74, 76 is moved by the release element 90 out of overlap with the respective other latching members 76, 74. For example, the release element 90 presses against the radial protrusion 80 of the receptacle 32 and deflects the radial protrusion 80 radially inwards, so that the latching member 74 may slide past the latching member 76 counter to the mounting direction 34. The length of the release element 90 in the mounting direction 34 is adapted to permit disengagement of the latching assembly 70 only if the terminal 12 is close to or touches the shoulder 24, or if the stud contact 4 is in the final installation position 50.

Figure 7:
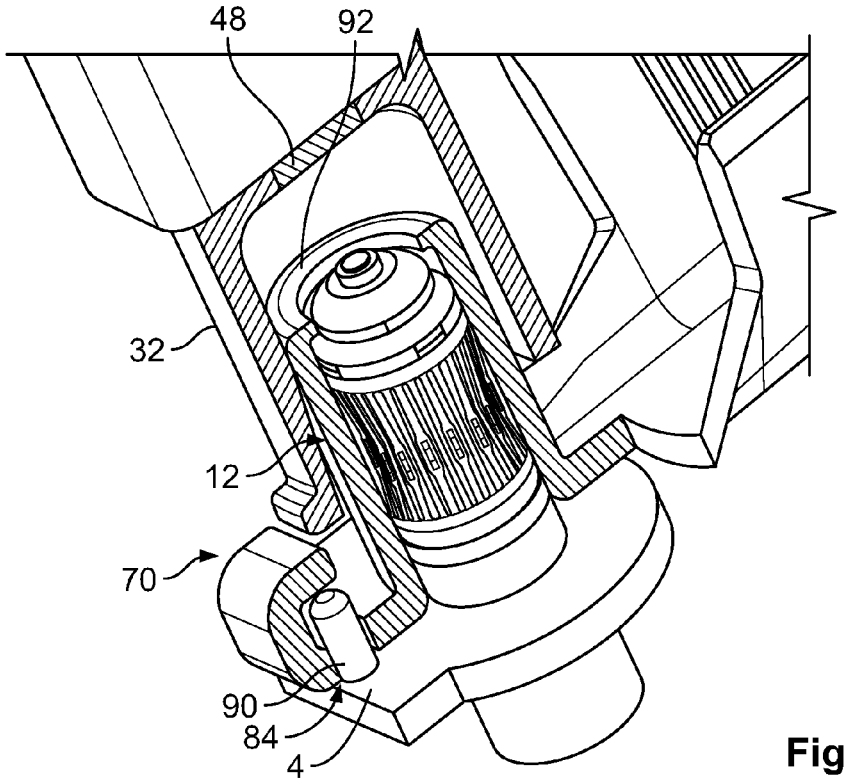
FIG. 7 is a sectional perspective view of the tool of FIG. 2 and the terminal positioned on the contact stud.

To help in inserting the release element 90 into the release opening 84, a guidance arrangement 92 shown in FIG. 7, such as a groove or any other radially asymmetric feature, may be provided on at least one of the receptacles 32, the terminal 12 and the stud contact 4. The guidance arrangement 92 allows to slip the terminal 12 over the stud contact 4 in only one position in which the release element 90 and the release opening 84 are aligned.

After disengagement of the latching assembly 70, as shown in FIG. 7, the receptacle 32 may be pulled from the terminal 12 which is held on the contact stud 4 by a positive lock and/or a frictional fit between the release element 90 and the release opening 84. The automatically disengageable latching assembly 70 may be used without the stud detector 48.

The tool 22 also has a terminal extractor 100, shown in FIGS. 8-11, which is adapted to engage the terminal 12 mounted onto the stud contact 4. The terminal extractor 100 forms a connection between the tool 22 and the terminal 12, which is axially tight against the stud contact 4 in the mounting direction 34, and thus allows removal of the terminal 12 from the stud contact 4 counter to the mounting direction 34. The terminal extractor 100 may be provided by the receptacle 32 together with the latching assembly 70 or without the latching assembly 70.

In order to avoid accidentally pulling off the terminal 12 right after mounting it onto the stud contact 4, the direction in which the terminal extractor 100 is brought into engagement with the terminal 12, is different from the direction of movement by which the latching assembly 70 is engaged or disengaged. For example, if the latching assembly 70 is engaged and disengaged by a motion of the tool 22 along the mounting direction 34, the terminal extractor 100 is engaged by a movement in a direction perpendicular to the mounting direction 34. The terminal extractor 100 may be adapted to engage the terminal 12 in a rotary motion 102. The terminal 12 and the terminal extractor 100 may both form complementary parts of a bayonet fastening 104.

Figure 8:
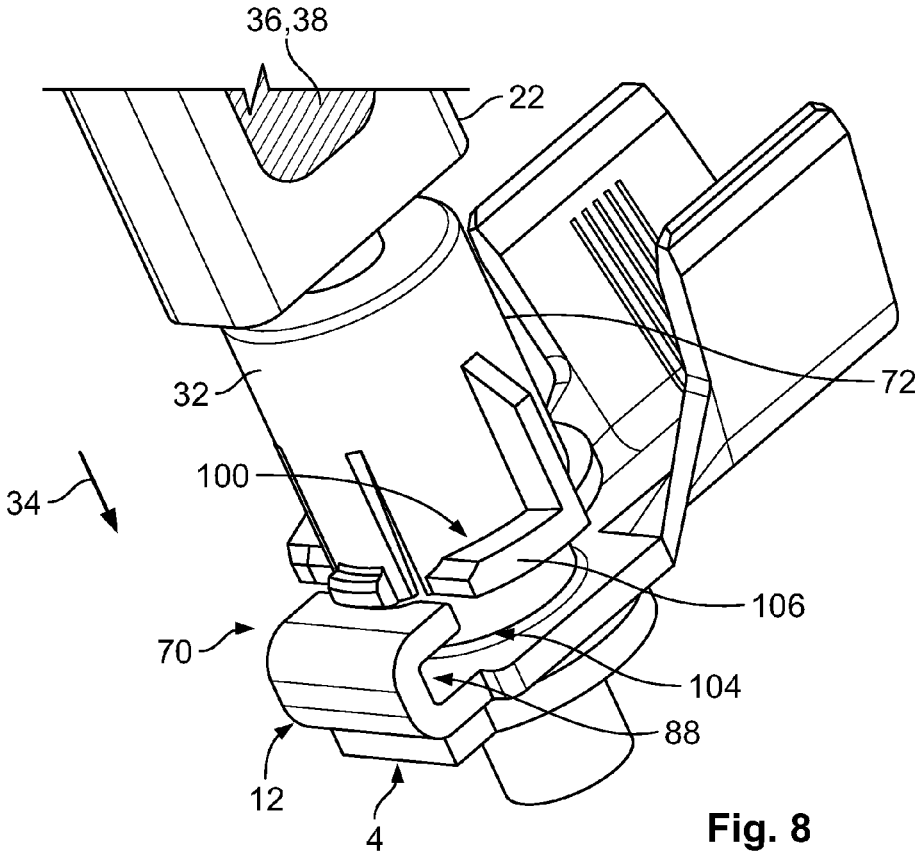
FIG. 8 is a perspective view of the tool of FIG. 2, the terminal, and the stud contact in a first position.
Figure 9:
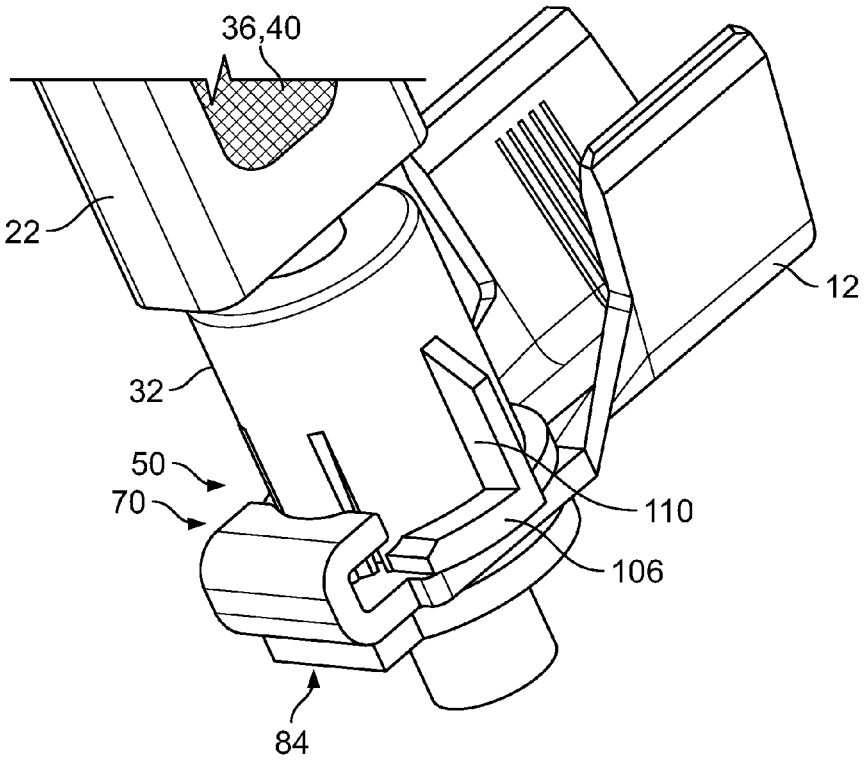
FIG. 9 is a perspective view of the tool of FIG. 2, the terminal, and the stud contact prior to engaging the tool with the terminal.
Figure 10:
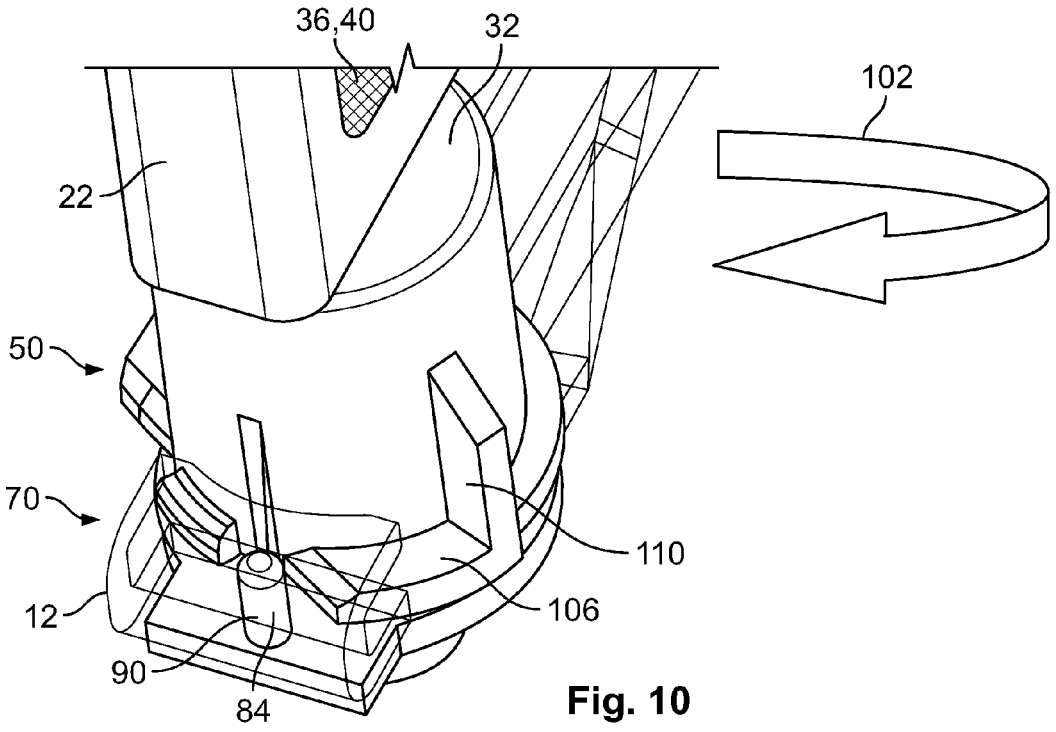
FIG. 10 is a perspective view of the tool of FIG. 2, the terminal, and the stud contact with the tool engaging the terminal.

The latch opening 88 formed by the terminal 12 receives a radially-protruding extractor latch 106 of the receptacle 32 upon a rotation of the receptacle 32 as shown in FIGS. 8-10. First, the receptacle 32 is pushed over the terminal 12 mounted onto the stud contact 4, as shown in FIG. 8. The terminal extractor 100 may be located on the outside 72 of the receptacle 32 adjacent the latching assembly 70, if the latter is present. When the receptacle 32 slides over the stud contact 4 with the terminal 12 being mounted thereon, the latching assembly 70 cannot engage due to the release element 90 still being located in the release opening 84 and blocking any engagement of the latching member 74, 76 as shown in FIG. 6. Thus, to effect a positive lock between the receptacle 32 and the terminal 12, the receptacle 32 is rotated by arrow 102 in FIG. 10, after the stud contact 4 is in the final installation position 50 shown in FIG. 9 and indicated by the indicator 36. The final installation position 50 can only be reached if the extractor latch 106 is outside the latch opening 88. Upon rotation 102, the extractor latch 106 is rotated into the latch opening 88 and forms the axially tight form fit. The release element 90 or a stop 110 on the receptacle may prevent any further rotation as shown in FIG. 10. The indicator 36 still shows that the final installation position 50 is maintained.

Figure 11:
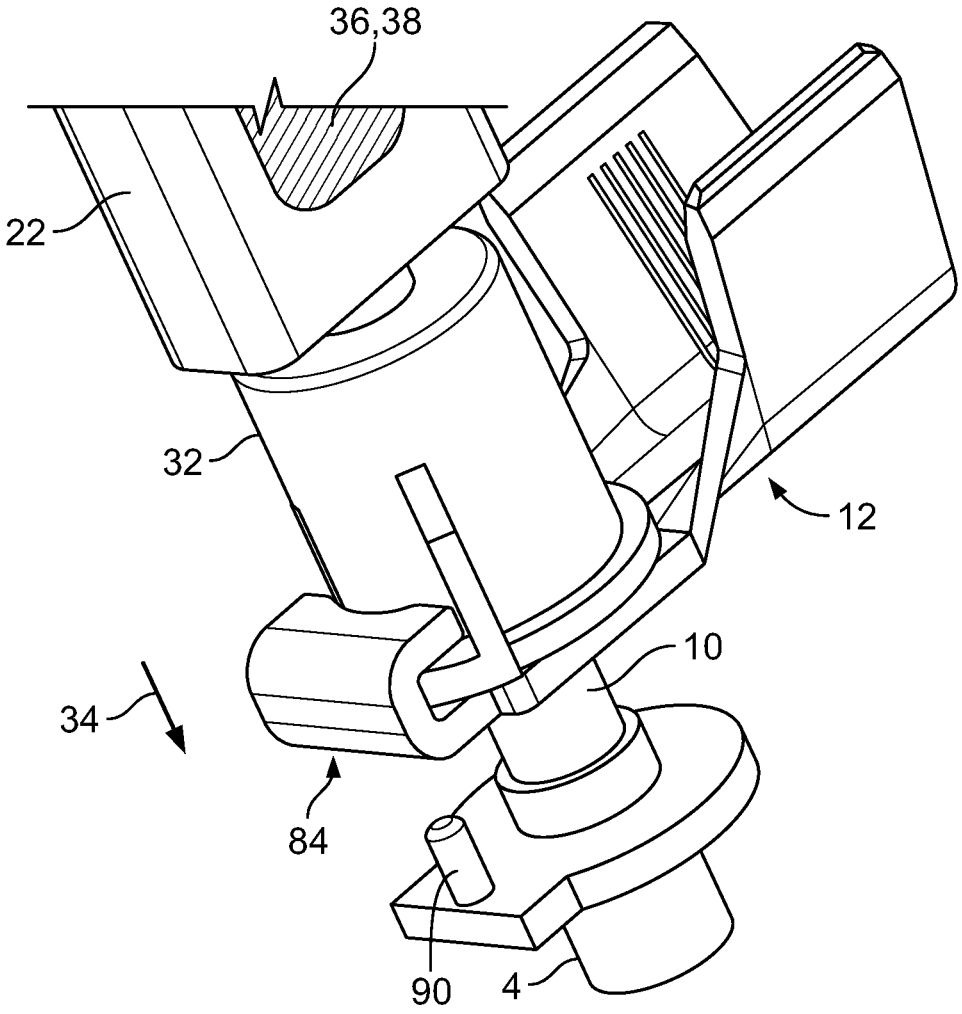
FIG. 11 is a perspective view of the tool of FIG. 2, the terminal, and the stud contact with the terminal removed from the contact stud.

Once the terminal extractor 100 is in the engaged state shown in FIG. 10, the terminal 12 can be pulled off from the contact stud 4 counter to the mounting direction 34, as shown in FIG. 11. The stud contact 4 and the tool 22 together form a ground contact mounting set which may also comprise the terminal 12.

What is claimed is:

1. A tool for mounting a terminal onto a stud contact, comprising:

a receptacle open in a mounting direction and receiving the terminal;

a stud detector detecting a final installation position of the stud contact within the receptacle; and an indicator visible from an exterior of the tool and connected to the stud detector, the indicator having a first visual appearance and a second visual appearance different from the first visual appearance, the indicator automatically switching between the first visual appearance and the second visual appearance based on whether the stud contact is in the final installation position.

2. The tool of claim 1, further comprising a latching assembly engaging the terminal.

3. The tool of claim 2, wherein the latching assembly has a release opening open in the mounting direction and receiving a release element to disengage the latching assembly.

4. The tool of claim 1, wherein the stud detector is disposed at a bottom of the receptacle.

5. The tool of claim 1, wherein the receptacle is formed by an adaptor interchangeably mounted to the tool.

6. A ground contact mounting set, comprising:

a stud contact having a trigger; and a tool having a receptacle open in a mounting direction and receiving a terminal, a stud detector interacting with the trigger in a final installation position of the stud contact within the receptacle, and an indicator visible from an exterior of the tool and connected to the stud detector, the indicator having a first visual appearance and a second visual appearance different from the first visual appearance, the indicator automatically switching between the first visual appearance and the second visual appearance based on whether the stud contact is in the final installation position.

7. The ground contact mounting set of claim 6, wherein the trigger is a protrusion.

8. The ground contact mounting set of claim 7, wherein the protrusion extends parallel to the mounting direction.

9. The ground contact mounting set of claim 8, wherein the protrusion protrudes from a top surface of the stud contact.

10. The ground contact mounting set of claim 6, wherein the tool has a latching assembly engaging the terminal.

11. The ground contact mounting set of claim 10, wherein the stud contact has a release element automatically disengaging the latching assembly in the final installation position.

12. The ground contact mounting set of claim 11, wherein the release element extends in the mounting direction.

13. The ground contact mounting set of claim 12, wherein the release element extends alongside the stud contact.

14. The ground contact mounting set of claim 12, wherein the release element engages a release opening of the terminal to friction fit the contact stud to the terminal.

15. The ground contact mounting set of claim 6, wherein the terminal is mounted on the stud contact and is axially tight against the stud contact in the mounting direction.

16. The ground contact mounting set of claim 15, wherein the tool has a terminal extractor engaging the terminal.

17. The ground contact mounting set of claim 16, wherein the terminal extractor engages the terminal in a rotary motion.

18. The ground contact mounting set of claim 17, wherein the terminal extractor is disposed on the receptacle.

19. The ground contact mounting set of claim 17, wherein, when the terminal extractor engages the terminal, the terminal can be removed from the contact stud in a direction counter to the mounting direction.

20. A method for mounting a terminal onto a stud contact using a tool, comprising:

inserting the terminal into a receptacle of the tool;

positioning the receptacle over the stud contact; and inserting the stud contact into the receptacle to a final installation position, an indicator of the tool having an automatically altered visual appearance based on whether the stud contact is in the final installation position.

* * * * *